United States Patent [19]

Eggelsmann et al.

[11] 4,024,424

[45] May 17, 1977

[54] ROTARY-ANODE X-RAY TUBE

[75] Inventors: Harry Eggelsmann; Claus Peter Hodum, both of Hamburg, Germany

[73] Assignee: U.S. Philips Corporation, New York, N.Y.

[22] Filed: Nov. 17, 1975

[21] Appl. No.: 632,587

[30] Foreign Application Priority Data

Nov. 27, 1974 Germany ..... 2455974

[52] U.S. Cl. ..... 313/60; 313/152
[51] Int. Cl.[2] ..... H01J 35/04
[58] Field of Search ..... 313/60

[56] References Cited

UNITED STATES PATENTS

| | | | |
|---|---|---|---|
| 2,939,015 | 5/1960 | Reiniger | 313/60 X |
| 3,801,846 | 4/1974 | Haberrecker | 313/60 |

*Primary Examiner*—Rudolph V. Rolinec
*Assistant Examiner*—Darwin R. Hostetter
*Attorney, Agent, or Firm*—Frank R. Trifari; George B. Berka

[57] ABSTRACT

A rotary anode X-ray tube wherein the anode carries the high voltage during operation; to achieve shorter acceleration times of the rotor, an insulator is provided between the rotor and the anode disc so that only a minimum air gap is required between the rotor and the stator.

7 Claims, 2 Drawing Figures

FIG. 1
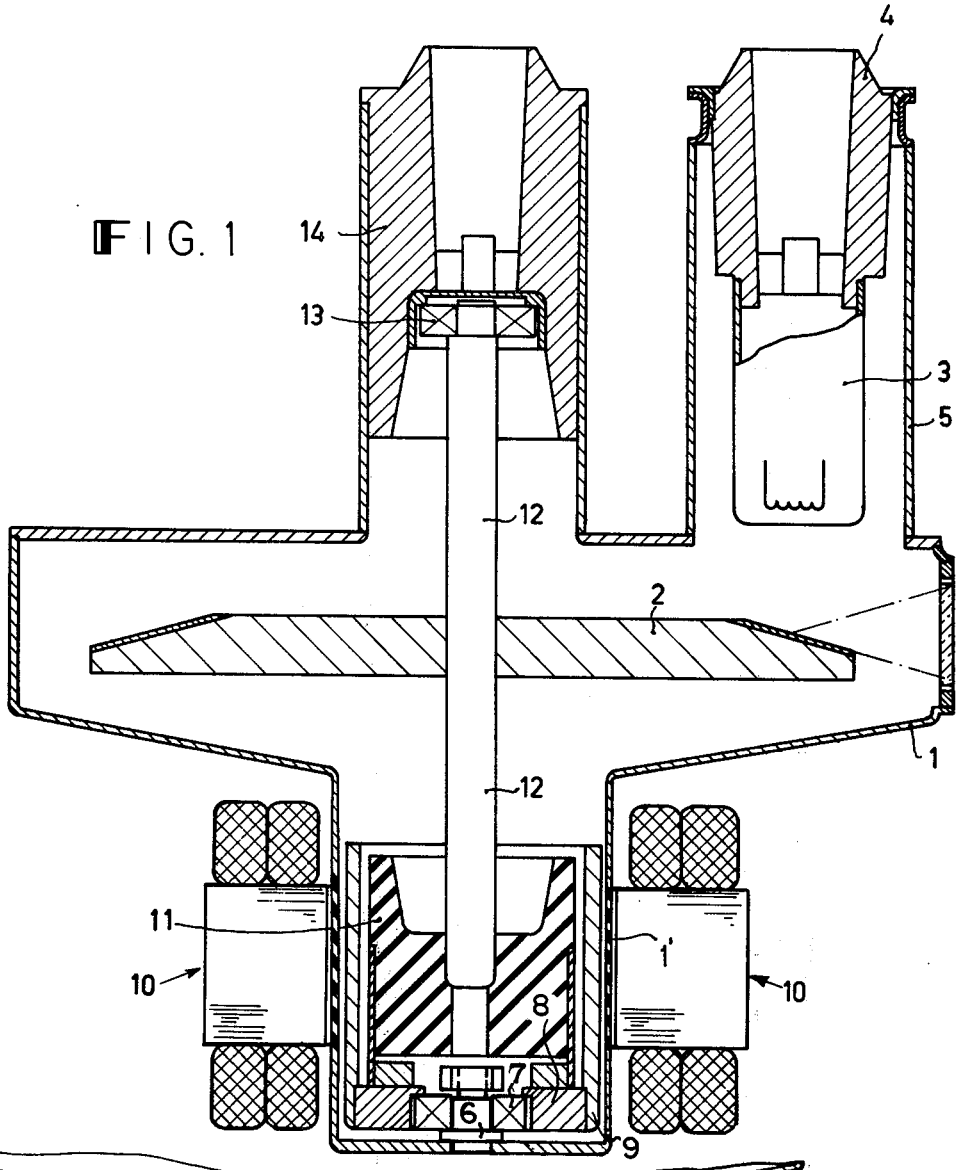
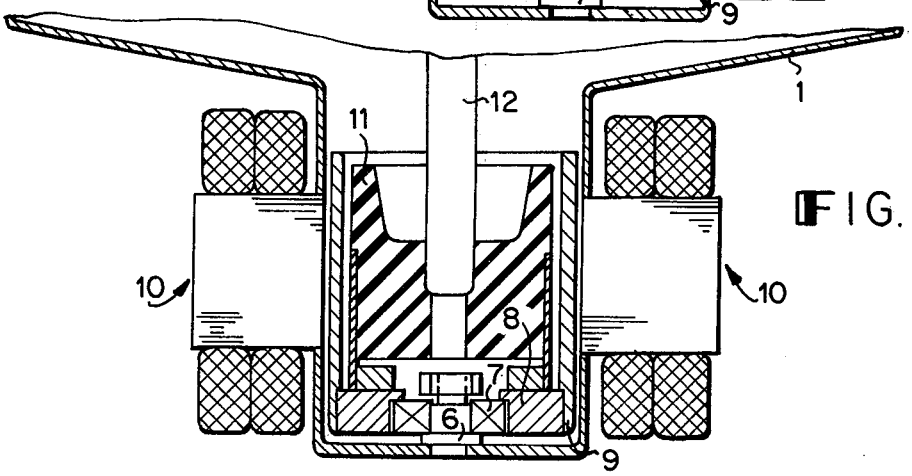
FIG. 2

ROTARY-ANODE X-RAY TUBE

The invention relates to an X-ray tube comprising a rotary anode which can be connected to a high voltage and which is mounted, by way of a rotary shaft, on a rotor to be driven by a stator.

Rotary-anode X-ray tubes of this kind are used in large numbers in practice, notably in medical radiation apparatus. These X-ray tubes have a drawback in that a comparatively long period of time is required for accelerating the anode (the term anode used herein is to be understood to mean the anode disc) from standstill or from a low speed to a comparatively high speed required for exposure. This acceleration time is longer as the diameter and the mass of the anode disc are larger.

The long acceleration time of these tubes is mainly due to a comparatively large air gap between stator and rotor. The large air gap serves to avoid flash-over between the stator which is usually at earth potential and the rotor which carries the high voltage potential of the anode. The air gap can hardly be reduced with respect to known tubes, so that the acceleration time cannot be reduced either.

X-ray tubes comprising a rotary anode which is at earth potential during operation, however, have a shorter acceleration time for the same stator power, because the air gap therein may be substantially smaller than in the former rotary-anode X-ray tubes. Because the anode of these X-ray tubes is at earth potential, the cathode must carry a negative potential during operation of the tube. As a result, X-ray tubes of this kind cannot be connected to a symmetrical high voltage generator, i.e. a high voltage generator which is capable of supplying a high voltage which is positive with respect to earth as well as a high voltage which is negative with respect to earth. These X-ray tubes, wherein the cathode operates at a high voltage, have a further drawback in that for filament current control of the tube an expensive insulation must be provided between the control section which is usually at earth potential and the filaments carrying the negative high voltage.

The invention has for its object to provide a rotary-anode X-ray tube wherein the anode can be connected to a high voltage and wherein the air gap between rotor and stator can be substantially smaller than in X-ray tubes of this kind known thus far.

This object according to the invention is achieved in that the anode in an X-ray tube of the kind set forth is connected to the rotor via an insulator which is preferably mounted on the rotary shaft. This insulator enables the rotor to assume approximately the potential of the stator, preferably earth potential, during operation of the tube. Because substantially no potential difference exists between the stator and the rotor during operation, the air gap can be made as small as is allowed by the mechanical construction. The insulator arranged between the rotor and the anode prevents high voltage flash-over.

The X-ray tube according to the invention differs from the known rotary anode X-ray tubes in that two voltages or potentials must be applied to the anode construction: the high voltage for the anode and earth for the rotor. In accordance with a further preferred embodiment of the tube according to the invention, the earth potential can be applied to the rotor in that the rotor is connected, via a bearing, to the envelope of the rotary-anode X-ray tube, the bearing being earthed. In rotary-anode X-ray tubes comprising a metal envelope, wherein the bearing constitutes a conductive connection between the metal envelope and the rotor, separate earthing of the bearing can be dispensed with.

In a further preferred embodiment of the rotary-anode X-ray tube according to the invention, the high voltage can be applied to the anode of the tube in that the rotary shaft of the anode is journalled in a further bearing which simultaneously serves as the high voltage inlet.

When the anode is magnetically journalled, the X-ray tube according to the invention being particularly suitable for this type of journalling because the rotor is at earth potential and because the air gap between rotor and stator is small, one sliding contact each which co-operates with the rotary shaft and the rotor can be used for the electrical connection of the rotor and the anode, respectively.

A preferred embodiment of the tube according to the invention will be described in detail hereinafter with reference to the drawing, in which:

FIG. 1 shows an X-ray tube of this invention, and

FIG. 2 is a modification of the stator of FIG. 1.

FIG. 1 shows an X-ray tube comprising a metal envelope 1. The envelope 1 has a mainly rotation-symmetrical construction, like the known rotary-anode X-ray tubes. The anode (actually the anode disc) 2 has a smoothed focussing path which is arranged opposite the cathode 3 which is connected, via an insulator 4—for example, of aluminium oxide ceramic—to a metal cylinder 5 which is connected to the envelope which comprises an opening at this area.

The anode is suspended at two areas. On the lower end of the metal envelope there is provided a stud 6 which is concentrical with respect to the rotary shaft and which supports a bearing 7 which is connected to the cylindrical rotor 9 via a ring 8. The stud 6, the bearing 7 and the ring 8 constitute a conductive connection between the envelope 1 and the rotor 9, so that the metal envelope and the rotor are earthed. The air gap between the rotor 9 and the stator 10, slid over the cylindrical portion of the envelope enclosing the rotor, may therefore be very small. The metal envelope 1 may not be magnetic at the area 1 of the rotor and the stator, so as not to attenuate the magnetic field between rotor and stator. Moreover, it should be slightly conductive so as to keep the eddy current losses low.

The ring 8 and hence the rotor 9 is connected—possibly via other rings for adaptation to the different temperature-dependent expansion behaviour—to an insulator 11 which is secured on a rotary shaft 12 supporting the anode disc 2. The insulator, preferably made of aluminium oxide ceramic, is constructed for the highest anode voltages occurring during operation. The portion of the rotary shaft between the anode 2 and the rotor 9 can possibly also be constructed as an insulator.

The high voltage is applied to the anode via a further bearing 13 which is provided in an insulator which is connected to the tube envelope 1 and which comprises a conical opening for accommodating a high voltage plug. The ball bearing 13 serves for journalling the rotary shaft 12. Consequently, the high voltage is applied to the anode via the bearing 13 and the rotary shaft 12. Therefore, the portion of the rotary shaft 12 between the bearing 13 and the anode disc 2 would have to be made of metal.

The embodiment of the tube according to the invention which is shown in FIG. 1 can be modified in various respects. Instead of a metal envelope, use can also be made of an envelope of an other material, for example, glass. The advantages achieved according to the invention, however, are most significant when use is made of metal envelope.

Instead of an anode disc, use can alternatively be made of a so-termed anode wheel, the electrons then being incident on a suitable, conically shaped circumference of the anode wheel. The cathode should then be arranged such that the electrons are accelerated in the direction perpendicular to the rotary shaft of the anode. Instead of a cylindrical rotor, use can alternatively be made of a disc-shaped rotor (for example, see Belgian Pat. No. 737,628).

Instead of the mechanical bearings 6 and 13, use can also be made of a magnetic bearing. In that case, separate sliding contacts must be provided to connect the rotor to earth and the anode to the high voltage.

It is not necessary for the anode disc to be journalled on both sides, even though this offers high stability. For example, if the tube envelope is extended in the downward direction and the rotor and stator are lowered accordingly, a ball bearing can be mounted on the shaft 12 between the anode and the rotor, the second bearing face of the said ball bearing being secured in an insulator which is laterally introduced into the metal envelope and which simultaneously serves to conduct the high voltage to the bearing and hence (via the rotary shaft) to the anode.

In a further preferred embodiment of the tube according to the invention, the stator is accommodated in the envelope of the X-ray tube, as shown in FIG. 2. Because a small space between stator and rotor then suffices, this can be effectively realized. The windings of the stator can then be accommodated or embedded in an envelope of synthetic material, with the result that it will not be necessary to solve vacuum-technical problems.

What is claimed is:

1. An X-ray tube comprising an envelope, and, within the envelope, a rotary anode including a shaft adapted for connection to a high potential, a rotor concentrically arranged around a portion of said shaft, an insulating member connecting the inner wall of said rotor to said shaft portion, and a stator separated from said rotor by a minimum gap.

2. A rotary anode X-ray tube as claimed in claim 1, wherein the envelope is at earth potential and said rotor is supported on a bearing connected to said envelope.

3. An X-ray tube as claimed in claim 1, wherein said stator is separated from said rotor by a portion of said envelope, said envelope portion being made of a non-magnetic material.

4. A rotary anode X-ray tube as claimed in claim 2, wherein the rotary shaft of the anode is journalled in a further bearing which serves as a high voltage inlet.

5. A rotary anode X-ray tube as claimed in claim 4, wherein the further bearing is arranged on the end of the shaft which is remote from the rotor.

6. A rotary anode X-ray tube as claimed in claim 5, wherein the tube envelope is made of metal, and the further bearing is mounted on an insulator which is connected to the metal envelope and which serves to accommodate a high voltage connector.

7. A rotary anode X-ray tube as claimed in claim 1, wherein the stator is accommodated in the envelope of the tube.

* * * * *